US006428313B1

(12) United States Patent
Rodgers et al.

(10) Patent No.: US 6,428,313 B1
(45) Date of Patent: Aug. 6, 2002

(54) SIDE SHOT BURNER

(75) Inventors: Ian M. Rodgers; Gerry L. Shavers, both of Ooltewah, TN (US)

(73) Assignee: Burner Systems International, Inc., Chattanooga, TN (US)

( * ) Notice: Subject to any disclaimer, the term of this patent is extended or adjusted under 35 U.S.C. 154(b) by 0 days.

(21) Appl. No.: 09/957,048

(22) Filed: Sep. 21, 2001

(51) Int. Cl.[7] ..... F23D 14/62; B21D 53/00; B05B 1/14

(52) U.S. Cl. ..... 431/354; 126/39 R; 126/41 R; 29/890.142; 29/890.02; 239/568; 239/601

(58) Field of Search ..... 431/354, 349; 29/283.5, 890.142, 890.02; 239/566, 567, 568, 601; 72/325, 326, 370.27; 126/39 R, 41 R, 39 C; 83/54

(56) References Cited

U.S. PATENT DOCUMENTS 3,386,431 A * 6/1968 Branson ..... 126/39 R
4,055,132 A * 10/1977 Stohrer, Jr. et al. ..... 72/326
4,118,175 A * 10/1978 Riehl ..... 431/354
4,156,591 A * 5/1979 Anderson ..... 239/567
4,418,456 A * 12/1983 Riehl ..... 29/890.02
5,103,545 A * 4/1992 Riehl ..... 29/283.5
5,133,657 A * 7/1992 Harris ..... 431/354

* cited by examiner

*Primary Examiner*—James C. Yeung
(74) *Attorney, Agent, or Firm*—Alan Ruderman; Stephen J. Stark; Miller & Martin

(57) ABSTRACT

A burner having an elongated cylindrical body closed at one end with a plurality of ports spaced apart in two rows along the upper segment of the body, said ports formed by punching. The ports have an upper edge and a lower edge wherein the lower edge is displaced a first distance below the upper edge and a second distance beyond a vertical axis tangent to the upper edge. Accordingly, flames are emitted substantially sideways out of the cylindrical body and any drippings on the tube are directed away from the cavity of the cylindrical body.

9 Claims, 1 Drawing Sheet

SIDE SHOT BURNER

BACKGROUND OF THE INVENTION

This invention relates to a gas burner of the type used extensively in gas grills, and in other commercial applications, and more particularly to a burner of this type having a plurality of ports to project flames directed out to either side of the burner.

The burner comprises an elongated tube closed at one end, gas being expelled from the tube to produce flames which burn at outlet ports along the length of the body. The prior art burners include a plurality of ports located on a top surface of the feed tube which look like slits cut into the tube. These ports were prone to clogging due to grease/fat drippings from the grill. One way to prevent clogging was to shield the burner from the drippings, but this increases the cost of the grill. Additionally, the heat distribution is relatively poor since the flame, and therefore the heat, went straight up.

It was thereafter contemplated that the slits should be made in the sides of the burner. This improved the heat distribution in the grill, but tended to cause the burner to overheat. Additionally, the ports were still exposed to drippings. Furthermore, when each side of the tube was ported, additional shielding and manufacturing concerns and steps were created.

SUMMARY OF THE INVENTION

Consequently, it is a primary object of the present invention to provide a gas burner having a plurality of ports in the burner body which direct flames at least partially out of the sides of the burner while at least partially protecting the ports from drippings clogging the ports.

It is another object of the present invention to provide a gas burner which provides a reduced flame height.

It is a further object of the present invention to provide a gas burner which may be manufactured by creating pairs of port openings from each stroke of a punch.

It is a still further object of the present invention to a gas burner with improved heat distribution as a result of spreading the flame about the grill.

It is a still further object of the present invention to provide a gas burner with cooler surface temperatures.

Accordingly, the present invention provides a burner having an elongated tubular body closed at one end and having a plurality of ports located along an upper portion of the tube, but not at the top. The openings within each of the ports are configured so that drippings, such as from grease, etc., do not normally enter the tube. Flames are directed sideways relative to the burner from the ports. When constructing the burner, a single stroke of a punch may create two ports, one on each side of a central vertical axis extending through the upper portion of the tube.

When the ports are punched into the tube, two openings are formed. The opening has a top edge and a bottom edge. The top edge remains at a height at substantially the level of the curvature of the tube while the lower edge is displaced somewhat lower than prior to punching. The moving of the lower edge pushes it so that if an axis is drawn vertically, or tangently, relative to the upper edge, the moved lower edge extends beyond the axis. Accordingly, if grease or other drippings were to drip off of the top edge, the drippings would land on the ledge formed by the punch before the bottom edge. The ledge is preferably angled so that droppings would flow with gravity about the circumference of the tube and off the bottom of the tube without entering the interior of the tube.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
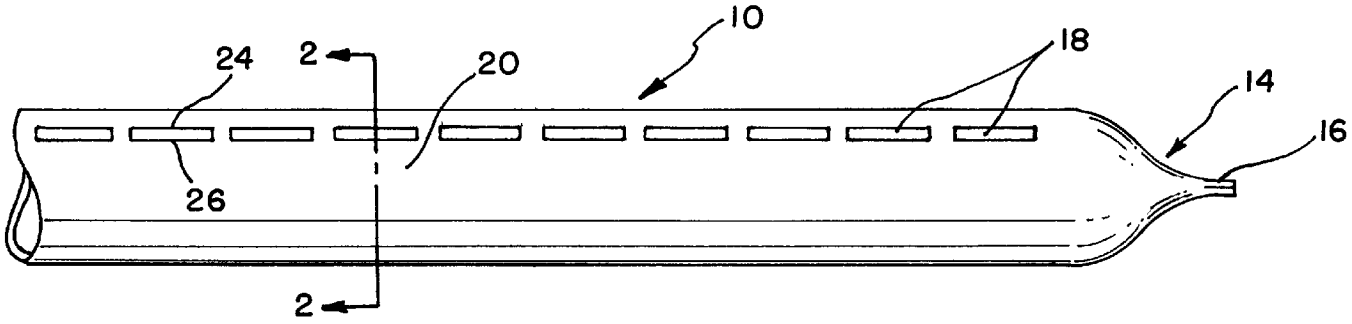
FIG. 1 is a side elevational view a portion of a burner of the preferred embodiment.
Figure 2:
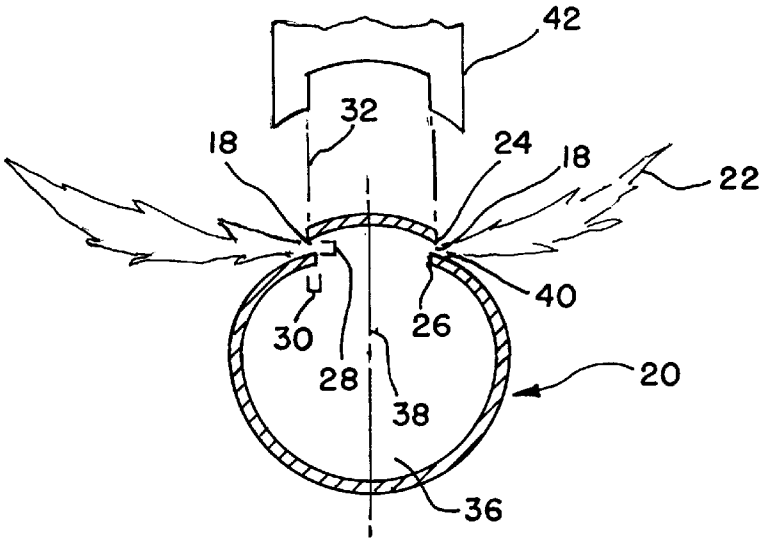
FIG. 2 is a preferred cross sectional view through the burner taken along line 2—2 of FIG. 1 with flames emitting from ports in the burner and a punch illustrated above the burner.

Referring to the drawings, a burner 10 is illustrated in FIGS. 1 and 2, the burner comprising a burner body 12 having an elongated cylindrical configuration with the burner body 12 having at least one closed end 14. The closed end 14 may be formed by crimping the burner body 12 adjacent the end 14 and forming flat mounting portion 16 extending from the crimping for attachment to an apparatus using the burner to provide a flame.

The burner 10 may have a number of applications including gas grills where drippings are a concern, as well as in traditional burner applications including gas water heaters, etc. The burner 10 of the preferred embodiment has a plurality of ports 18 in two spaced rows located on an upper segment 20 of the burner 10, each row being spaced from the central vertical axis 38 of the burner body 12, as well as a distance from the top of the body 12. The ports 18 are designed to project flames 22 sideways from the burner 10.

Each of the ports 18 provide an outlet for gas to be expelled from the burner body 12 where a flame 22 can be initially directed sideways from the burner 10. The ports 18 of the preferred embodiment may be created, two at a time, with a single stroke of a punch 42. As the punch strikes the burner 10 at the two locations, the cylinder 12 is pierced and two edges, a top edge 24 and a bottom edge 26 are formed for each of the two ports 18. The top edge 24 is located higher than the bottom edge 26 after each of the ports 18 is created. Of course, ports 18 may be created individually or in multiples other than two at a time as well. The pairs of ports 18 are located opposite a central vertical axis of the burner body 12.

Additionally, as the punch punctures the cylinder 12, it moves the bottom edge 26 downwardly a first distance 28 from the top edge 24. The bottom edge 26 is also displaced toward the central vertical axis 38 a second distance 30 beyond the top edge 24. Accordingly, if a second vertical axis 32 were drawn tangently along the top edge 24, the bottom edge 26 would extend the second distance 30 beyond the tangent vertical axis 32 so that the second vertical axis 32 would intersect ledge 40. By locating the bottom edge 26 relative to the top edge 24 in this manner, the top edge 24 "overlaps" the bottom edge 26.

There may be other methods of "overlapping" the top edge 24 relative to the bottom edge 26 to at least partially shield the ports 18 from clogging other than by punching the burner body 12 with a punch, however, this technique has been found to be very cost effective.

Accordingly, if liquid were to contact the top surface 34 of the cylinder 12 along one of the ports 18 as illustrated in FIG. 2, it would drop across the port 18 and strike the outer surface of the cylinder 12 along the upper portion 20 of the cylinder along the ledge 40. The liquid could then proceed around the cylinder 12 to the bottom where it may drop off. The liquid would not tend to enter within the cavity 36 within the cylinder 12. Additionally, the flow of gas from the ports 18 will be in a substantially sidewise direction as illustrated in FIG. 2 so that any drippings over the port would be subjected to direct sideways force at the pressure differential between the gas pressure in the cavity 36 and the external environment which would also tend to push the droppings away from the port 18 and around the cylinder 12.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A burner comprising:

a burner body having a hollow substantially cylindrical configuration extending longitudinally along at least a portion thereof, said burner body having an upper portion; and a plurality of ports located in two spaced apart rows extending longitudinally along said upper portion of the burner body, each of said plurality of ports having an upper edge and a lower edge, said upper edge located a first distance above the lower edge, and said lower edge extending a second distance beyond a vertical axis tangent to the upper edge.

2. The burner of claim 1 wherein the burner body has a closed end.

3. The burner of claim 2 wherein the closed end comprises a planar clamped portion.

4. The burner of claim 1 wherein the plurality of ports are arranged in opposing pairs spaced relative to a central vertical axis of the substantially cylindrical configuration of the burner body.

5. The burner of claim 1 wherein the plurality of ports are formed by punching.

6. A burner formed by the process comprising:

a. providing a substantially elongated cylindrical burner body;

b. punching a plurality of ports along an upper portion of the burner body in two spaced apart rows, each of said ports having an upper edge and a lower edge, said upper edge spaced a first distance above the lower edge, and said lower edge extending a second distance beyond a vertical axis tangent to the upper edge.

7. The burner of claim 6 wherein the step of punching further comprises punching opposing pairs of ports simultaneously with a single stroke of a punch, said opposing pairs of ports substantially equidistant from a central vertical axis of the cylindrical tube portion.

8. A method of manufacturing a burner comprising the steps of:

a. providing an elongated cylindrical body member;

b. punching a plurality of ports along an upper portion of the cylindrical body member in two spaced apart rows, each of said ports having an upper edge and a lower edge, said upper edge spaced a first distance above the lower edge, and said lower edge extending a second distance beyond a vertical axis tangent to the upper edge.

9. The method of claim 8 wherein the step of punching further comprises punching opposing pairs of ports simultaneously with a single stroke of a punch, said opposing pairs of ports substantially equidistant from a central vertical axis of the cylindrical tube portion.

* * * * *